US009651896B2

(12) United States Patent
Massaro, Jr.

(10) Patent No.: US 9,651,896 B2
(45) Date of Patent: May 16, 2017

(54) METHOD FOR REATTACHING A FLOATING MAGNETIC ROLLER SECTION OF TONER CARTRIDGES

(71) Applicant: FLO-TECH, LLC, Middletown, CT (US)

(72) Inventor: Peter Vincent Massaro, Jr., West Haven, CT (US)

(73) Assignee: Flo-Tech, LLC, Middletown, CT (US)

( * ) Notice: Subject to any disclaimer, the term of this patent is extended or adjusted under 35 U.S.C. 154(b) by 45 days.

(21) Appl. No.: 14/324,483

(22) Filed: Jul. 7, 2014

(65) Prior Publication Data

US 2016/0004189 A1 Jan. 7, 2016

(51) Int. Cl.

*G03G 15/00* (2006.01)
*G03G 15/08* (2006.01)
*G03G 21/18* (2006.01)

(52) U.S. Cl.

CPC ..... *G03G 15/0894* (2013.01); *G03G 15/0881* (2013.01); *G03G 21/181* (2013.01); *G03G 2215/00987* (2013.01)

(58) Field of Classification Search

None
See application file for complete search history.

(56) References Cited

U.S. PATENT DOCUMENTS 4,846,774 A * 7/1989 Bell ..... B31D 1/0018 413/12
5,223,068 A * 6/1993 Baley ..... G03G 15/0894 141/364
5,370,761 A * 12/1994 Chitouras ..... B29C 65/18 156/94
5,407,518 A * 4/1995 Baley, Jr. ..... G03G 15/0894 156/257
5,531,846 A * 7/1996 Miraglia ..... G03G 15/0894 156/322
5,621,508 A * 4/1997 McNamara ..... G03G 15/0894 156/94

(Continued)

FOREIGN PATENT DOCUMENTS

JP H11149208 A 6/1999
WO 2007016520 A2 2/2007

*Primary Examiner* — David Gray
*Assistant Examiner* — Geoffrey T Evans
(74) *Attorney, Agent, or Firm* — Bachman & LaPointe, P.C.

(57) ABSTRACT

A method for remanufacturing toner cartridges, wherein original equipment manufacturer (OEM) sealant is removed and replaced with an aftermarket sealant. A hopper assembly is disassembled from a toner cartridge and cleaned to remove residual toner. The hopper assembly is then heated using an oven, heat gun, etc. in order to loosen the OEM sealant binding the hopper assembly. Once thoroughly heated, the hopper assembly is dismantled into a hopper section and a mag section. The OEM sealant is removed from the hopper section and replaced with the aftermarket sealant using an automated robot as the hopper section is held by a jig. A floating mag gasket attached to the mag section is either cleaned and reinstalled or replaced with a new floating mag gasket. The mag section is then reattached to the hopper section using an alignment tool in order to ensure proper positioning of components to create a fluid tight seal.

19 Claims, 11 Drawing Sheets

(56) References Cited

U.S. PATENT DOCUMENTS

| | | | | |
|---|---|---|---|---|
| 5,799,712 | A * | 9/1998 | Kelly | G03G 15/0894 141/287 |
| 5,839,028 | A * | 11/1998 | Nomura | G03G 21/181 141/18 |
| 6,185,393 | B1 * | 2/2001 | Karakama | G03G 15/0942 399/103 |
| 6,289,188 | B1 | 9/2001 | Litman et al. | |
| 6,587,657 | B2 * | 7/2003 | Sirejacob | G03G 15/0894 399/106 |
| 6,684,039 | B1 | 1/2004 | Wazana et al. | |
| 2002/0159788 | A1 * | 10/2002 | Miyabe | G03G 21/181 399/109 |
| 2003/0116272 | A1 * | 6/2003 | Aubert | C08G 73/12 156/327 |
| 2003/0205311 | A1 * | 11/2003 | Chitouras | B29C 65/18 156/94 |
| 2005/0276628 | A1 * | 12/2005 | Anan | G03G 21/181 399/109 |
| 2006/0060287 | A1 | 3/2006 | Chitouras | |
| 2009/0245856 | A1 | 10/2009 | Holmes et al. | |
| 2011/0293322 | A1 * | 12/2011 | Shanun | G03G 15/0882 399/109 |
| 2012/0033990 | A1 * | 2/2012 | Lewis | F16J 15/061 399/109 |
| 2014/0270842 | A1 * | 9/2014 | Gonzalez | G03G 15/0898 399/103 |
| 2014/0314442 | A1 * | 10/2014 | Massaro, Jr. | G03G 15/0894 399/109 |

* cited by examiner

METHOD FOR REATTACHING A FLOATING MAGNETIC ROLLER SECTION OF TONER CARTRIDGES

FIELD OF THE INVENTION

The present invention relates generally to the remanufacturing of used toner cartridges. More specifically, the present invention is a method for removing and replacing the original equipment manufacturer (OEM) sealant between the hopper and mag sections of a toner cartridge, as well as ensuring that the hopper and mag sections are properly aligned and reattached. The present invention seeks to facilitate the reassembly process of the toner cartridge during remanufacturing.

BACKGROUND OF THE INVENTION

Modern imaging devices such as laser printers, photocopiers, and facsimile (fax) machines typically include a replaceable toner cartridge that holds toner that is transferred to a substrate to create an image. Once expended, a toner cartridge is often discarded and replaced with a fresh cartridge. However, disposing of and replacing an exhausted toner cartridge can be prohibitively expensive as well as harmful to the environment. Remanufacturing of exhausted toner cartridges seeks to increase the reusability of the toner cartridges for both financial and environmental reasons.

The remanufacturing process generally involves dismantling a used cartridge, replacing any worn or defective parts, cleaning the cartridge components, and refilling the cartridge with toner. A large number of toner cartridges comprise two major components: a hopper assembly and a waste bin assembly. The hopper assembly generally comprises a mag section. The mag section provides a level of movement to compensate for any component misalignments during a printing process.

During the remanufacturing process, the mag section of the hopper assembly is generally removed and reattached. Because the mag section of the hopper assembly must be able to move or float during a printing process, it is important that the mag section is properly reattached to the hopper section to permit movement and floating as needed. As a result, proper alignment and sealing between the hopper section and the mag section in order to ensure that the remanufactured toner cartridge functions correctly. The present invention seeks to address the aforementioned issues as well as provide a means for facilitating the remanufacturing process for toner cartridges.

The present invention is a method for removing and replacing the original equipment manufacturer (OEM) sealant between the hopper and mag sections of a toner cartridge hopper assembly and ensuring proper alignment between the two sections during reassembly. In the preferred embodiment of the present invention, a toner cartridge undergoing remanufacturing is disassembled by separating the hopper assembly and waste bin assembly of the cartridge. The two assemblies are thoroughly cleaned in order to remove any toner present on the components. The hopper assembly is then heated in an oven or by a heat gun in order to increase the pliability of the OEM sealant between the hopper section and mag section of the hopper assembly. The OEM sealant is then removed and the mag section gasket is inspected and cleaned or replaced as needed. The hopper section is placed into a jig in order to apply aftermarket sealant onto the hopper section. The aftermarket sealant is applied by an automated robot that dispenses the sealant along the edge of the hopper section that mates with the mag section. After the aftermarket sealant has been applied, an alignment tool is utilized to properly realign and reattach the mag section to the hopper section. The aftermarket sealant ensures that the gasket of the mag section is able to properly adhere to the hopper section and form a complete seal between the two sections. After reassembly is complete, the seal between the hopper section and the mag section is inspected in order to ensure that the seal is complete.

DETAIL DESCRIPTIONS OF THE INVENTION

Figure 1:
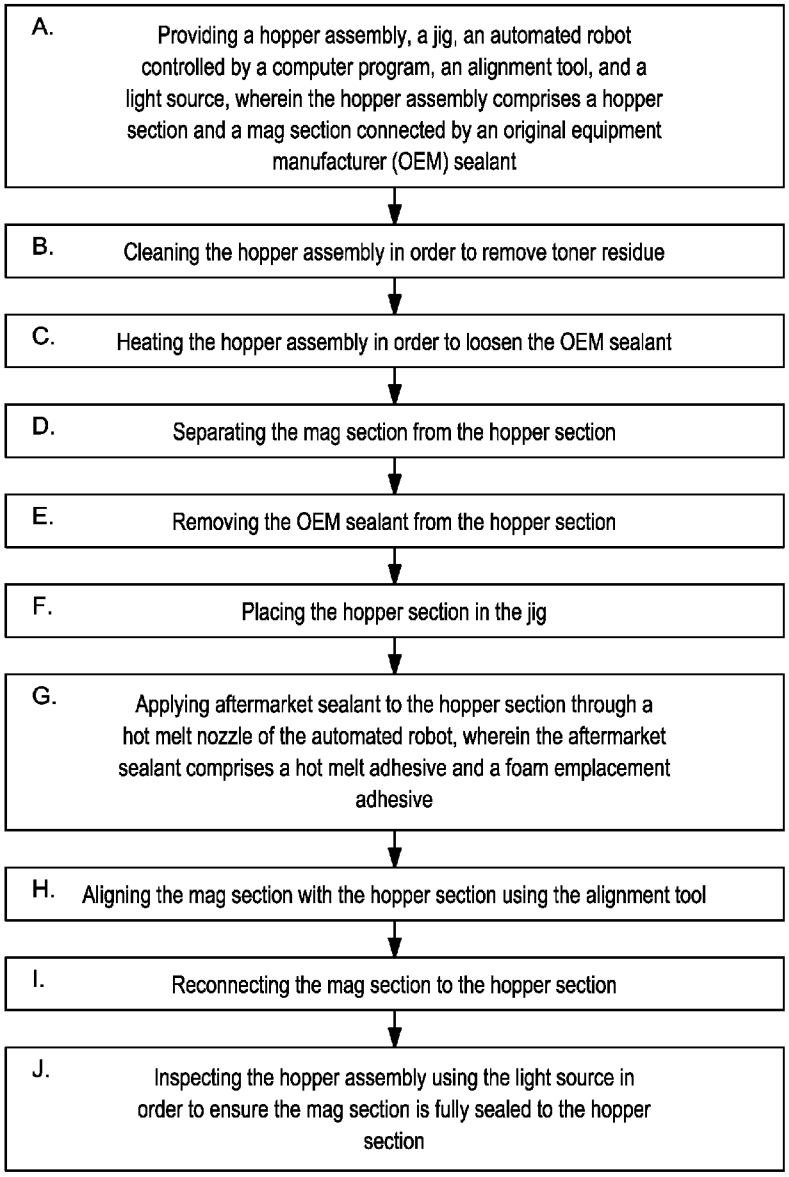
FIG. 1 is a flowchart detailing the steps for remanufacturing a toner cartridge.

All illustrations of the drawings are for the purpose of describing selected versions of the present invention and are not intended to limit the scope of the present invention.

The present invention is a method for remanufacturing a toner cartridge that improves on current toner cartridge remanufacturing processes. The method of the present invention is hereinafter described as a process for removing an original equipment manufacturer (OEM) sealant 13 between a hopper section 11 and a mag section 12 of a hopper assembly 10 in a toner cartridge; however, it is possible for the method of the present invention to be adapted for removing the OEM sealant 13 between other sections of a toner cartridge as well. The OEM sealant 13 is replaced by an aftermarket sealant 20 and the hopper section 11 and the mag section 12 of the hopper assembly 10 are realigned utilizing an alignment tool 50 prior to reassembly.

In reference to FIG. 1, during the remanufacturing process of a toner cartridge, the toner cartridge is first disassembled, wherein a waste bin assembly of the toner cartridge is separated from a hopper assembly 10 of the toner cartridge and all internal components of the toner cartridge are removed. Following disassembly, the waste bin assembly and the hopper assembly 10 are thoroughly cleaned in order to remove any toner residue remaining on the components of the two assemblies. Preferably, the waste bin assembly and the hopper assembly 10 are loaded into an automated cleaning machine to perform the cleaning.

Figure 2:
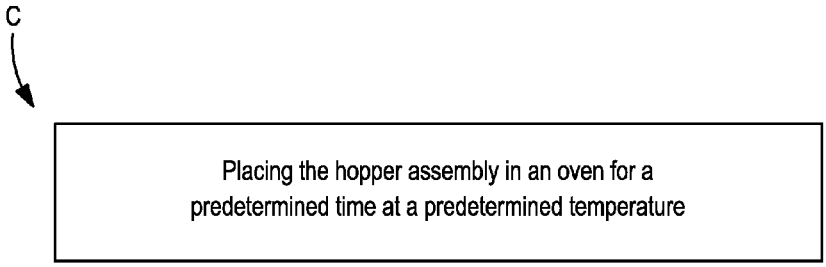
FIG. 2 is a flowchart detailing the preferred method for heating the hopper assembly.

In further reference to FIG. 1, the hopper assembly 10 comprises the hopper section 11 and the mag section 12, which are joined by the OEM sealant 13. In order to separate the hopper section 11 from the mag section 12, the OEM sealant 13 must be loosened. Once the hopper assembly 10 of the toner cartridge has been cleaned, the hopper assembly 10 is heated in order to loosen the OEM sealant 13. In reference to FIG. 2, in the preferred embodiment of the present invention, an oven is used to heat the hopper assembly 10. The oven is heated to a predetermined temperature as to loosen the OEM sealant 13 but not deform the hopper assembly 10. The hopper assembly 10 is then placed in the oven for a predetermined time in order to fully loosen the OEM sealant 13.

Figure 3:
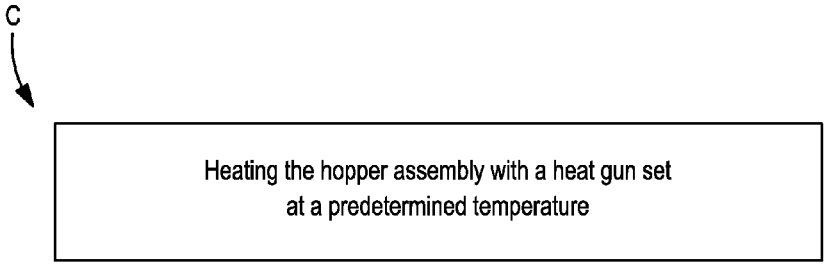
FIG. 3 is a flowchart detailing an alternative method for heating the hopper assembly.

In reference to FIG. 3, in an alternative embodiment of the present invention, a heat gun is used to heat the hopper assembly 10. The heat gun is set to the predetermined temperature as to loosen the OEM sealant 13 but not deform the hopper assembly 10. Once the heat gun has reached the predetermined temperature, the heat gun is around the seal between the hopper section 11 and the mag section 12, both around the inside and outside of the hopper assembly 10 in order to fully loosen the OEM sealant 13. In addition to the heating methods described, it is possible for the hopper assembly 10 to be heated in any other way in order to loosen the OEM sealant 13.

Application of heat to the hopper assembly 10 increases the pliability of the OEM sealant 13 that joins the hopper section 11 to the mag section 12. In reference to FIG. 1, after the OEM sealant 13 has become sufficiently pliable, the mag section 12 is separated from the hopper section 11 by pulling the two components apart. The OEM sealant 13 is then removed from the hopper section 11. The OEM sealant 13 can be wiped/scraped off by hand or through the use of a specialized machine.

Figure 4:
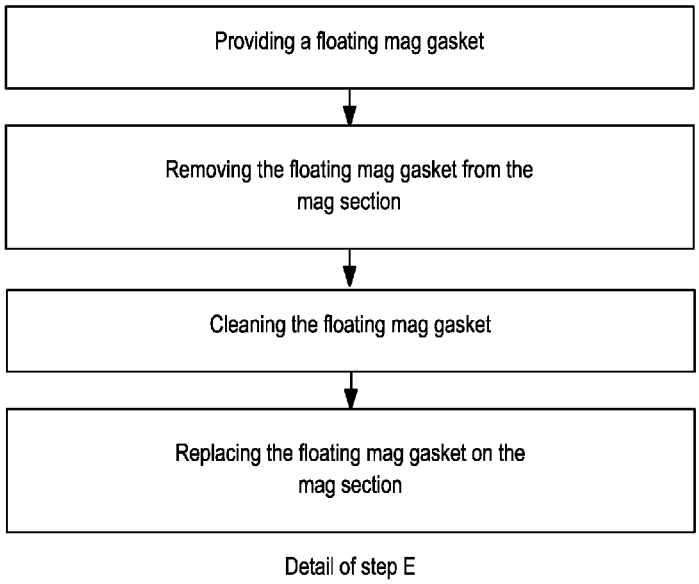
FIG. 4 is a flowchart detailing the additional steps of removing and cleaning the floating mag gasket of the hopper assembly.
Figure 5:
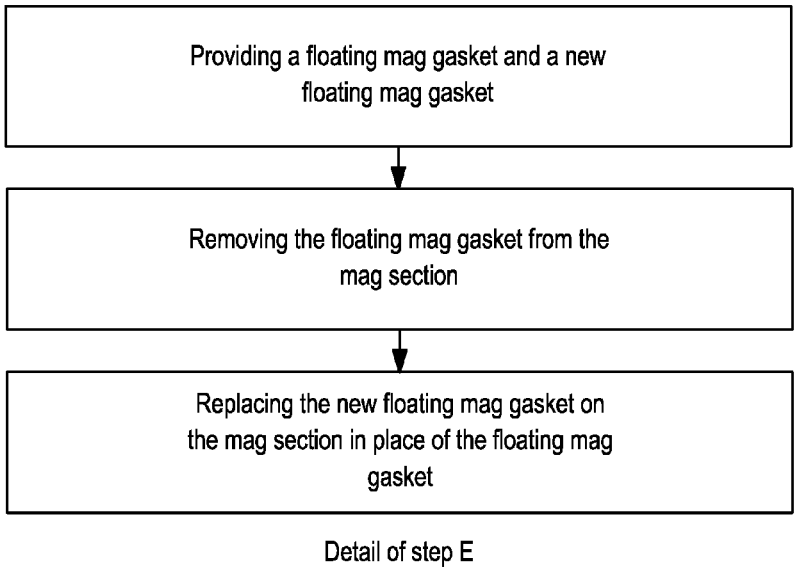
FIG. 5 is a flowchart detailing the additional steps of removing the floating mag gasket and replacing the floating mag gasket with a new floating mag gasket.
Figure 8:
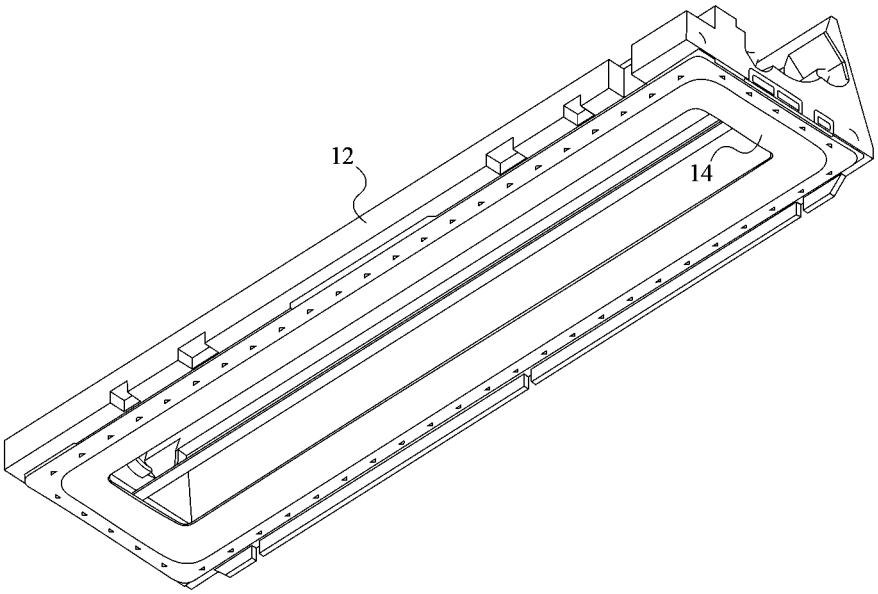
FIG. 8 is a perspective view of the mag section.

In reference to FIG. 8, the hopper assembly 10 also typically comprises a floating mag gasket 14 that is positioned in between the mag section 12 and the hopper section 11. As an intermediary layer between the hopper section 11 and the mag section 12, the floating mag gasket 14 prevents toner from leaking from the hopper section 11 into the mag section 12 when the components are assembled together. In reference to FIG. 4-5, once the mag section 12 is separated from the hopper section 11, the floating mag gasket 14 is removed from the gasket section. The floating mag gasket 14 can then either be cleaned and replaced on the mag section 12, or a new floating mag gasket 14 can be provided and used to replace the floating mag gasket 14.

Figure 6:
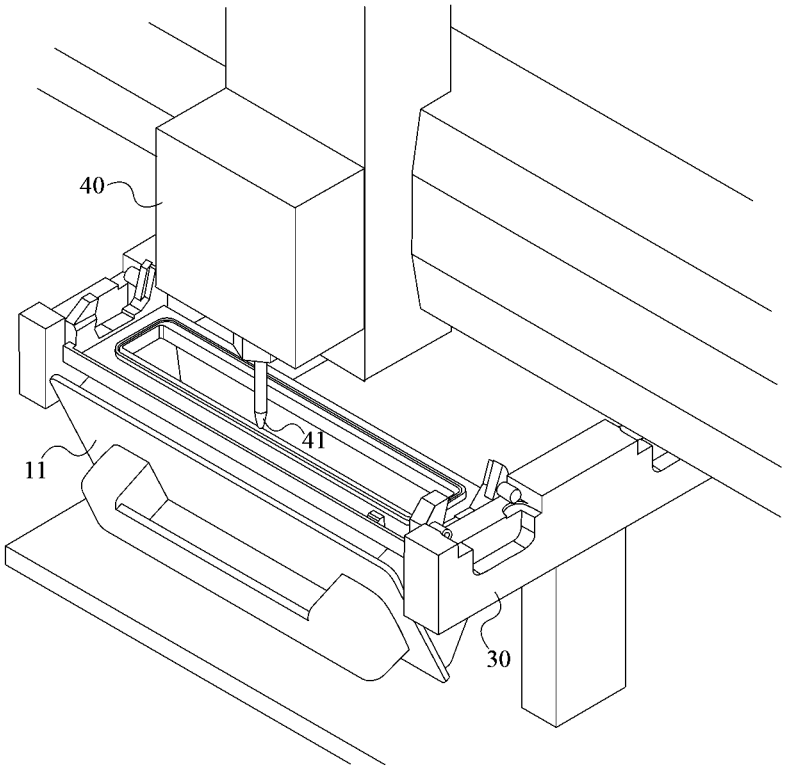
FIG. 6 is a perspective view of the hopper section positioned in the jig with the automated robot aligned to dispense the aftermarket sealant through a hot melt nozzle.

In reference to FIG. 1, following cleaning or replacement of the floating mag gasket 14, the hopper section 11 of the hopper assembly 10 is loaded into a jig 30 as shown in FIG. 6. In the preferred embodiment of the present invention, the jig 30 is designed to accommodate the hopper section 11 from a plurality of toner cartridges, and as such, the jig 30 comprises a plurality of slots for accommodating and holding secure the hopper section 11 of each of the plurality of toner cartridges. It is also possible for the jig 30 to be designed to accommodate the hopper section 11 from a single toner cartridge, and as such, the jig 30 would comprise a single slot for holding the hopper section 11.

In reference to FIG. 6, the jig 30 serves as a means for assisting in the controlled application of the aftermarket sealant 20 to the hopper section 11 of the hopper assembly 10. The jig 30 holds the hopper section 11 in a steady, fixed position, such that the aftermarket sealant 20 can be evenly distributed about the opening edge of the hopper section 11. Additionally, the jig 30 ensures repeatability and accuracy of the aftermarket sealant 20 application process when applying the sealant to multiple hopper section 11 of a plurality of toner cartridges in sequence. The jig 30 may be designed to receive the hopper section 11 from a single type of toner cartridge or the hopper section 11 of multiple types of toner cartridges.

In the preferred embodiment of the present invention, an automated robot 40 is utilized to dispense the aftermarket sealant 20 onto the hopper section 11. In reference to FIG. 7, the aftermarket sealant 20 is dispensed by the automated robot 40 along the opening edge of the hopper section 11. The automated robot 40 is controlled and regulated by a computer program that ensures that the aftermarket sealant 20 is applied evenly along the opening edge of the hopper section 11 where the mag section 12 is secured to the hopper section 11. As such, the computer program may include instructions for directing the automated robot 40 along different paths in order to account for the various sizes and shapes of the hopper section 11 of multiple types of toner cartridges.

Figure 7:
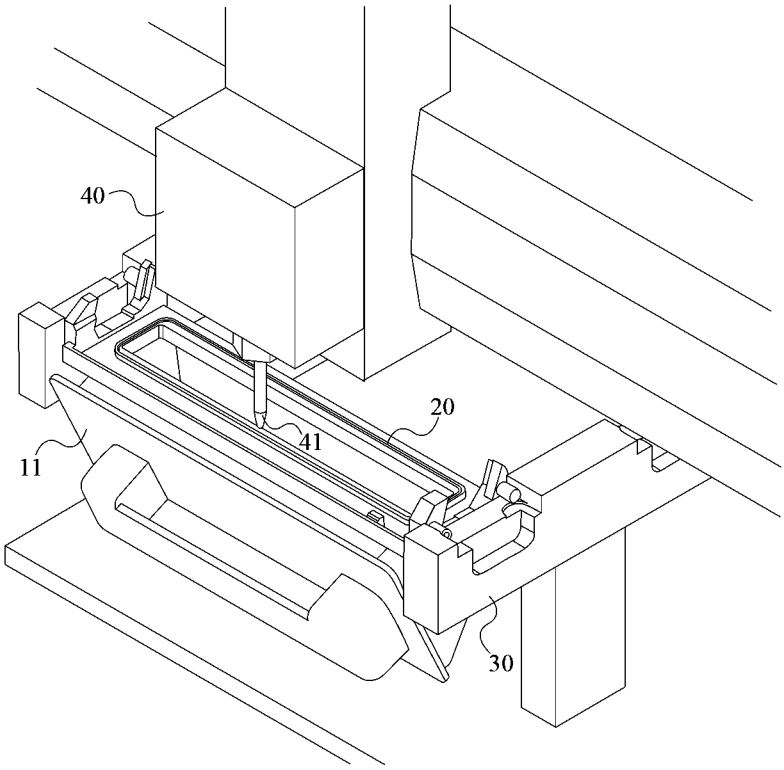
FIG. 7 is a perspective view of the hopper section positioned in the jig, wherein the aftermarket sealant has been applied to the hopper section by the automated robot.

In further reference to FIG. 7, the automated robot 40 comprises a hot melt nozzle 41 that is used to dispense the aftermarket sealant 20 onto the hopper section 11. The hot melt nozzle 41 helps to regulate the continuous application of the aftermarket sealant 20. In the preferred embodiment of the present invention, the aftermarket sealant 20 applied by the automated robot 40 comprises a hot melt adhesive 21 and a foam emplacement adhesive 22. This ensures that the seal formed between the hopper section 11 and the mag section 12 of the toner cartridge is watertight and durable.

Figure 9:
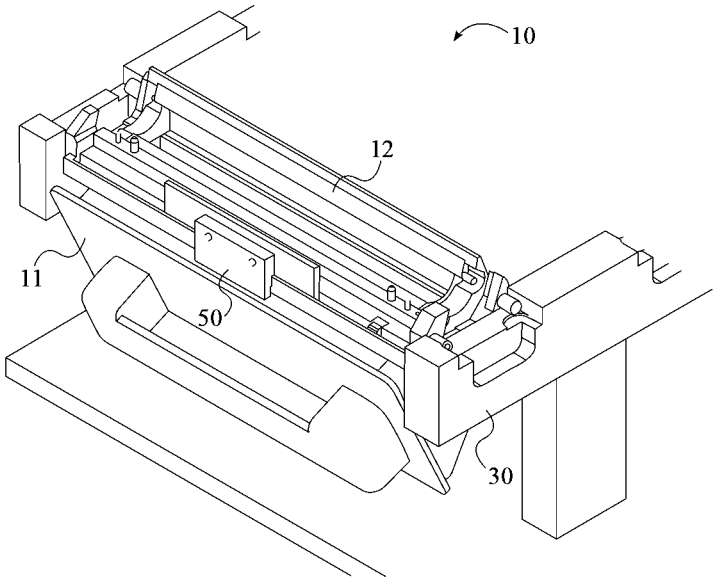
FIG. 9 is a perspective view of the mag section being attached to the hopper section using the alignment tool, with the hopper section being held by the jig.
Figure 10:
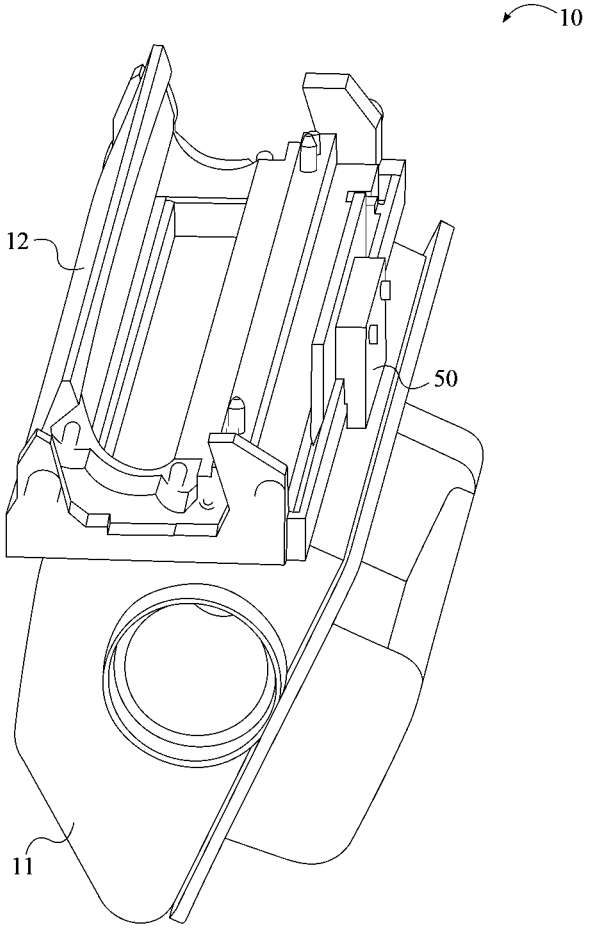
FIG. 10 is a perspective view of the mag section being attached to and aligned with the hopper section using the alignment tool.
Figure 11:
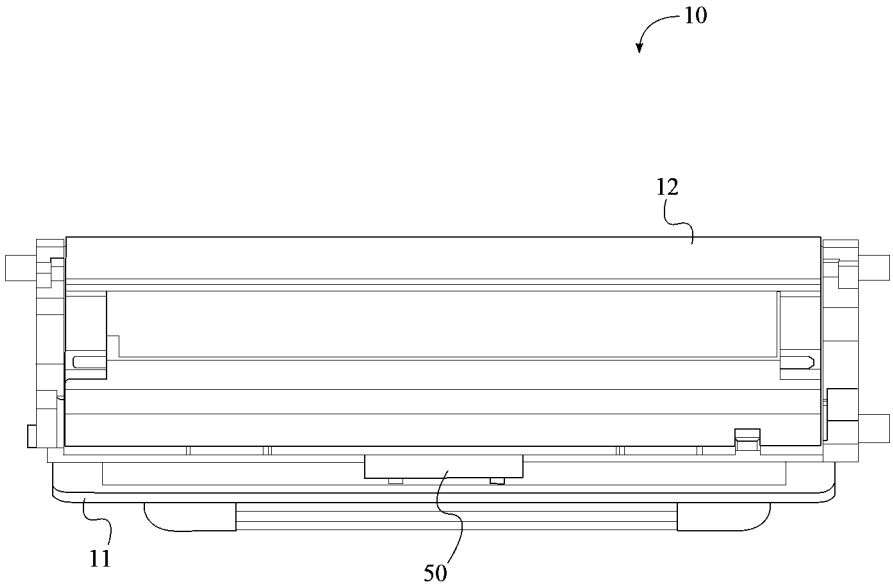
FIG. 11 is a top plan view of the mag section being attached to and aligned with the hopper section using the alignment tool.

In reference to FIG. 1, the hopper assembly 10 of the toner cartridge is reassembled following application of the aftermarket sealant 20 to the hopper section 11 of the hopper assembly 10. It is important to ensure that the mag section 12 is properly aligned with the hopper section 11 as the mag section 12 is reattached to the hopper section 11 in order to ensure that the remanufactured toner cartridge functions properly. As such, in the preferred embodiment of the present invention, an alignment tool 50 is utilized to properly reattach the mag section 12 to the hopper tool, as shown in FIG. 9-11. The alignment tool 50 rests in between the mag section 12 and the hopper section 11 as the mag section 12 is reattached to the hopper section 11 in order to ensure proper spacing and alignment of the mag section 12 and the hopper section 11. The alignment tool 50 may be designed to work with the mag section 12 and the hopper section 11 from a single type of toner cartridge or the mag section 12 and the hopper section 11 of multiple types of toner cartridges.

When the mag section 12 is properly aligned with the hopper section 11, the mag section 12 is lowered, such that the mag section 12 is pressed against the hopper section 11 in order to reattach the mag section 12 to the hopper section 11, as shown in FIG. 9. When the mag section 12 is reattached to the hopper section 11, the aftermarket sealant 20 distributed around the opening edge of the hopper section 11 adheres to the mag section 12 or the floating mag gasket 14, forming a complete seal between the hopper section 11 and the mag section 12.

Once the mag section 12 and the hopper section 11 have been pressed together, the aftermarket sealant 20 is given time to dry in order to form a complete seal between the mag section 12 and the hopper section 11. In reference to FIG. 1, the seal formed between the hopper section 11 and the mag section 12 is then inspected to ensure that there are no irregularities or openings in the seal. In the preferred embodiment of the present invention, the seal is inspected using a light source (e.g. light emitting diodes—LEDs) that is used to shine light between the hopper section 11 and the mag section 12, wherein light passing through the hopper assembly 10 indicates a failure in the seal. This method of inspection allows for rapid identification of any gaps in the aftermarket sealant 20 between the mag section 12 and the hopper section 11 that may prove problematic in the future if left unresolved. Preferably the light source is a light stick or wand of light emitting diodes, however, any other light emitting device may be used.

The object of the present invention is to improve the remanufacturing process for toner cartridges. The method of the present invention allows for the convenient disassembly of a toner cartridge without damaging the individual components of the toner cartridge. Additionally, the use of the alignment tool 50 to reattach the mag section 12 of the hopper section 11 to the hopper assembly 10 following application of the aftermarket sealant 20 ensures that the mag section 12 is reattached in the proper original alignment and orientation to ensure functionality of the toner cartridge following remanufacturing.

Although the invention has been explained in relation to its preferred embodiment, it is to be understood that many other possible modifications and variations can be made without departing from the spirit and scope of the invention as hereinafter claimed.

What is claimed is:

1. A method for remanufacturing a toner cartridge including the steps of:

providing a hopper assembly comprising a hopper section and a magnetic section connected by a first sealant;

heating the hopper assembly in order to loosen the first sealant and make the first sealant pliable;

separating the magnetic section from the hopper section after the first sealant becomes pliable;

removing a floating magnetic gasket from between the magnetic section and the hopper section, wherein said floating magnetic gasket is configured as an intermediary layer between the hopper section and the magnetic section to prevent a toner from leaking from the hopper section into the magnetic section when the hopper section and magnetic section are assembled together;

cleaning the floating magnetic gasket;

replacing the floating magnetic gasket on the magnetic section;

removing the first sealant from the hopper section;

applying a second sealant to the hopper section; and reconnecting the magnetic section to the hopper section.

2. The method for remanufacturing a toner cartridge as claimed in claim 1, wherein said heating step comprises placing the hopper assembly in an oven for a predetermined amount of time at a temperature sufficient to loosen the first sealant without deforming the hopper assembly.

3. The method for remanufacturing a toner cartridge as claimed in claim 1, wherein said heating step comprises using a heat gun to heat the hopper assembly at a temperature sufficient to loosen the first sealant without deforming the hopper assembly.

4. The method for remanufacturing a toner cartridge as claimed in claim 1, further including the steps of:

removing a floating magnetic gasket from the magnetic section; and placing a new floating magnetic gasket on the magnetic section.

5. The method for remanufacturing a toner cartridge as claimed in claim 1, further including the steps of:

providing a jig; and placing the hopper section in the jig.

6. The method for remanufacturing a toner cartridge as claimed in claim 5, wherein said jig providing step comprises providing a jig having at least one slot for receiving at least one hopper section.

7. The method for remanufacturing a toner cartridge as claimed in claim 5, wherein said jig providing step comprises providing a jig having a plurality of slots for receiving a plurality of hopper sections.

8. The method for remanufacturing a toner cartridge as claimed in claim 1, wherein said second sealant applying step comprises providing an automated robot controlled by a computer program and having a hot melt nozzle, and applying the second sealant through the hot melt nozzle.

9. The method for remanufacturing a toner cartridge as claimed in claim 1, wherein said second sealant applying step comprises applying a sealant which comprises a hot melt adhesive and a foam emplacement adhesive.

10. The method for remanufacturing a toner cartridge as claimed in claim 1, further including the steps of:

providing an alignment tool which rests between said magnetic section and said hopper section as said magnetic section is reattached to said hopper section; and aligning said magnetic section with the hopper section using the alignment tool.

11. The method for remanufacturing a toner cartridge as claimed in claim 10, further including the step of:

moving the magnetic section so that said magnetic section is present against said hopper section.

12. The method for remanufacturing a toner cartridge as claimed in claim 1, further including the steps of:

providing a light source; and inspecting the hopper assembly using the light source in order to ensure the magnetic section is fully sealed to the hopper section.

13. The method for remanufacturing a toner cartridge as claimed in claim 1, wherein said first sealant removing step comprises removing an original equipment manufacturer (OEM) sealant and wherein said second sealant applying step comprises applying an aftermarket sealant.

14. A method for remanufacturing a toner cartridge including the steps of:

providing a hopper assembly having a hopper section and a magnetic section connected by a first sealant, a jig, and an automated robot controlled by a computer program, said automated robot having a hot melt nozzle;

heating the hopper assembly in order to loosen the first sealant;

separating the magnetic section from the hopper section;

removing the first sealant from the hopper section;

removing a floating magnetic gasket from between the magnetic section and the hopper section, wherein said floating magnetic gasket is configured as an intermediary layer between the hopper section and the magnetic section to prevent a toner from leaking from the hopper section into the magnetic section when the hopper section and magnetic section are assembled together;

cleaning the floating magnetic gasket;

replacing the floating magnetic gasket on the magnetic section;

placing the hopper section in the jig;

applying a second sealant to the hopper section through the hot melt nozzle of the automated robot; and reconnecting the magnetic section to the hopper section.

15. The method according to claim 14, wherein said heating step comprises placing said hopper assembly in an oven.

16. The method according to claim 14, wherein said heating step comprises utilizing a heat gun to heat the hopper assembly.

17. The method according to claim 14, wherein said second sealant applying step comprises applying a sealant which comprises a hot melt adhesive and a foam emplacement adhesive.

18. The method according to claim 14, further including the steps of:

providing an alignment tool; and aligning the magnetic section with the hopper section using the alignment tool.

19. The method according to claim 18, further including the steps of:

providing a light source; and inspecting the hopper assembly using the light source in order to ensure the magnetic section is fully sealed to the hopper section.

* * * * *